US005732576A

United States Patent [19]

Moore et al.

[11] Patent Number: 5,732,576

[45] Date of Patent: Mar. 31, 1998

[54] V-SHAPED SAFETY SHIELD FOR HANDCUFFS

[76] Inventors: Eddie G. Moore, Rte. 3, Box 230, Cushing, Okla. 74023; Jerrell Bray, HC-82, Box 812, Atoka, Okla. 74525

[21] Appl. No.: 845,527

[22] Filed: Apr. 25, 1997

[51] Int. Cl.[6] ..... E05B 75/00

[52] U.S. Cl. ..... 70/16; 128/878

[58] Field of Search ..... 70/14, 18; 119/770, 119/816, 819; 128/878, 879

[56] References Cited

U.S. PATENT DOCUMENTS

| | | | |
|---|---|---|---|
| 2,949,761 | 8/1960 | Mitchell et al. | 70/16 |
| 3,007,331 | 11/1961 | Irwin | 70/16 |
| 3,616,665 | 11/1971 | Rosenthal | 70/16 |
| 3,740,977 | 6/1973 | Stefansen et al. | 70/16 |
| 4,469,096 | 9/1984 | Rivadeneyra | 128/879 |
| 5,007,257 | 4/1991 | Thompson | 70/16 |
| 5,233,848 | 8/1993 | Elam | 70/16 |
| 5,343,562 | 9/1994 | Bible | 70/16 X |
| 5,526,658 | 6/1996 | Cross | 70/16 |

*Primary Examiner*—Lloyd A. Gall

*Attorney, Agent, or Firm*—Dunlap & Codding, P.C.

[57] ABSTRACT

A V-shaped safety shield for a pair of handcuffs including a pair of wristlets interconnected with a flexible chain is provided. The safety shield includes a housing having a first end portion and a second end portion angularly disposed relative to the first end portion. The housing is positionable about the chain of the handcuffs such that the wristlets are extendable from the first and second end portions of the housing in an angular relationship to one another when the housing is positioned about the chain such that upon securing the wristlets about the wrists of an individual the wristlets are disposed substantially concentrically around the wrists of the individual when the individual's wrists are positioned in a substantially corresponding angular relationship.

10 Claims, 4 Drawing Sheets

V-SHAPED SAFETY SHIELD FOR HANDCUFFS

STATEMENT REGARDING FEDERALLY SPONSORED RESEARCH OR DEVELOPMENT

Not applicable.

CROSS-REFERENCE TO RELATED APPLICATION

Not applicable.

BACKGROUND OF THE INVENTION

1. Field of the Invention

The present invention relates generally to safety shields for handcuffs, and more particularly, but not by way of limitation, to an improved safety shield having an angular configuration whereby the wristlets of a pair of handcuffs are set in an angular relationship relative to one another when the safety shield is positioned about the handcuffs to permit the wristlets to lay substantially concentrically around the wrists of an individual when the individual's wrists are secured in close proximity to the individual's torso.

2. Brief Description of the Related Art

Law enforcement personnel and prison guards routinely use handcuffs for prisoner restraint. Handcuffs are generally of standardized construction and include a pair or wristlets pivotally and rotatably connected by a short link chain. Each wristlet comprises a ratchet bar pivotally connected to a double strand wristlet body having internal teeth which permit rotation of the ratchet bar only inwardly therethrough, but prevent withdrawal in the opposite direction. Once applied to the wrist of a prisoner, the ratchet bar can be released or disengaged only with a key insertable into a keyhole on the wristlet. Doublelock handcuffs are provided with a second lock for fixing the wristlet circumference in a selected position so that the ratchet bar can not be continually squeezed inwardly when the wristlet is applied to the wrist of a prisoner.

A problem encountered in the use of handcuffs with a flexible connecting chain is that prisoners have a certain degree of freedom to manipulate their hands because of the flexible connection between the wristlets. As such, a prisoner can batter an officer or bystander while restrained in the handcuffs or possibly pick the locks of the handcuffs. To avoid such problems, shielding and reinforcing devices have been previously proposed to improve the safety of using conventional handcuffs.

Examples of such devices are disclosed in U.S. Pat. No. 3,740,977, issued to Stefansen et al., and U.S. Pat. No. 5,007,257, issued to Thompson. Stefansen et al. and Thompson disclose a hinged, box-like assembly adapted to be positioned about the handcuff chain and wristlets so as to provide a rigid, linear structure and to cover the keyholes of the first locks. Thompson further discloses providing access to the second locks via apertures aligned with the second locks when the device is positioned and closed about the handcuffs.

While many of the prior art shielding devices, including those taught by the above mentioned patents, have achieved varying degrees of success, problems have nevertheless been encountered when the handcuffs are secured to a belly chain. More specifically, when handcuffs are applied to a prisoner's wrist and in turn secured to a belly chain, the prisoner's wrists are caused to be brought into close proximity to the prisoner's torso thereby causing the wrists to spread outwardly in an angular relationship. Because the prior art shielding devices provide a rigid structure with the wristlets being in a linear relationship to one another, use of the prior art shielding devices results in the prisoner's wrists being in a skewed or cocked relationship with respect to the wristlets. Such a relationship restricts circulation in the prisoner's wrists and can result in injury to the prisoner if maintained for an extended period of time.

To this end, a need exists for an improved handcuff shield that precludes relative movement of the wristlets and yet permits the wristlets to lay substantially concentrically around the wrists of an individual when the individual's wrists are secured in close proximity to the individual's torso. It is to such a device that the present invention is directed.

BRIEF SUMMARY OF THE INVENTION

The present invention is directed to a safety shield for a pair of handcuffs wherein the handcuffs include a pair of wristlets interconnected with a flexible chain. The safety shield includes a housing having a first end portion and a second end portion angularly disposed relative to the first end portion. The housing is positionable about the chain of the handcuffs such that the wristlets are extendable from the first and second end portions of the housing in an angular relationship to one another when the housing is positioned about the chain such that upon securing the wristlets about the wrists of an individual the wristlets are disposed substantially concentrically around the wrists of the individual when the individual's wrists are positioned in a substantially corresponding angular relationship.

The objects, features and advantages of the present invention will become apparent from the following detailed description when read in conjunction with the accompanying drawings and appended claims.

BRIEF DESCRIPTION OF THE SEVERAL VIEWS OF THE DRAWING

FIG. 6 is a top view of the safety shield of the present invention shown secured to the torso of an individual with a belly chain and positioned about a pair of handcuffs which are secured about the wrists of the individual.

DETAILED DESCRIPTION OF THE INVENTION

Figure 1:
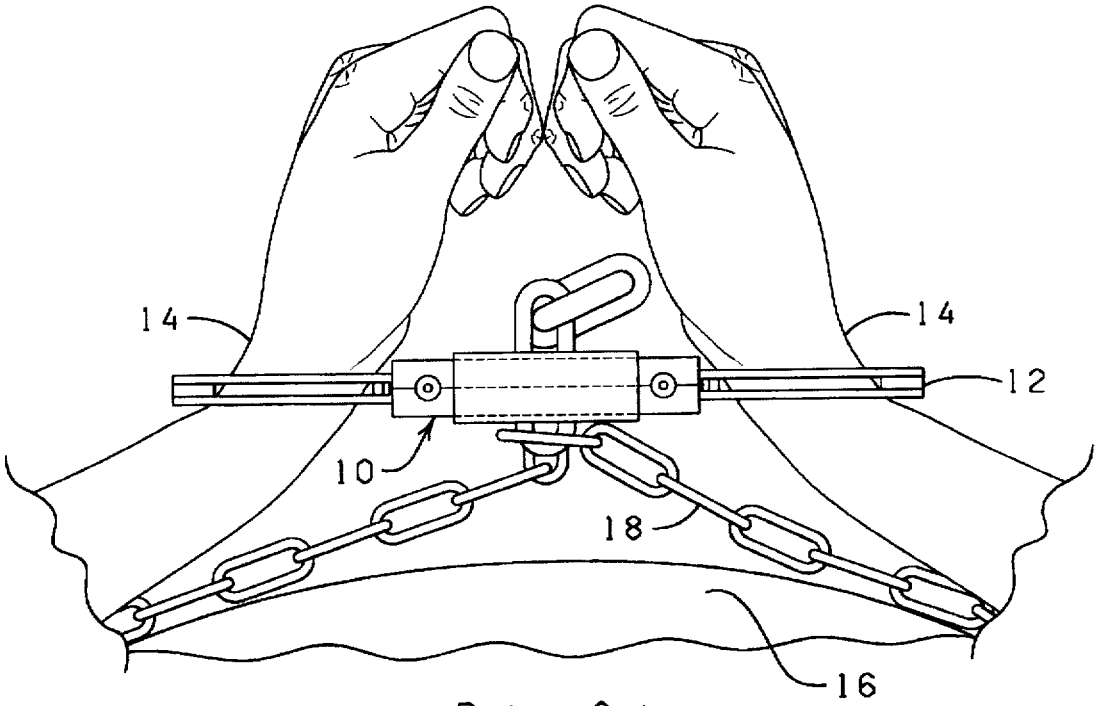
Prior Art FIG. 1
FIG. 1 is a top view of a prior art safety shield shown secured to the torso of an individual with a belly chain and positioned about a pair of handcuffs which are secured about the wrists of the individual.

Referring now to the drawings and more particularly to FIG. 1, a prior art safety shield 10 is shown positioned about a pair of handcuffs 12 which are secured about the wrists 14 of an individual. The safety shield 10 is further shown to be secured to the torso 16 of the individual with a belly chain 18. The safety shield 10 is a hinged, box-like assembly adapted to be positioned about the flexible chain (not shown in FIG. 1) and wristlets of the handcuffs 12 to cover the keyholes of the first locks and to provide a rigid structure about the flexible chain of the handcuffs.

As mentioned above and as illustrated in FIG. 1, use of the safety shield 10 in combination with a belly chain, or some other type device for securing an individual's wrist in close proximity to the individual's waist, can result in considerable pain to the individual. That is, when handcuffs are applied to an individual's wrist and in turn secured to a belly chain, the individual's wrists are caused to be brought into close proximity to the individual's torso thereby causing the wrists to spread outwardly in an angular relationship. Because the prior art shielding devices provide a rigid structure with the wristlets being in a linear relationship to one another, use of the safety shield 10 results in the individual's wrists being in a skewed or cocked relationship with respect to the wristlets, which can result in injury to the individual due to restricted blood circulation in the individual's hands.

Figure 3:
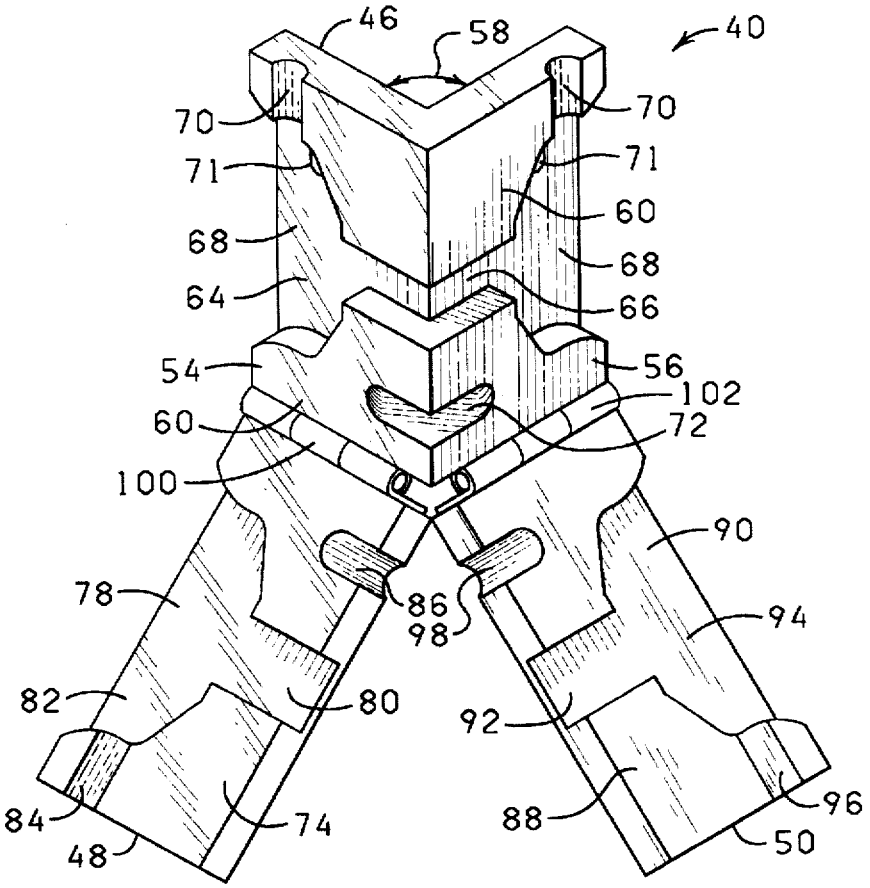
FIG. 3 is a perspective view of the safety shield of the present invention showing the cover plates in an open position.
Figure 4:
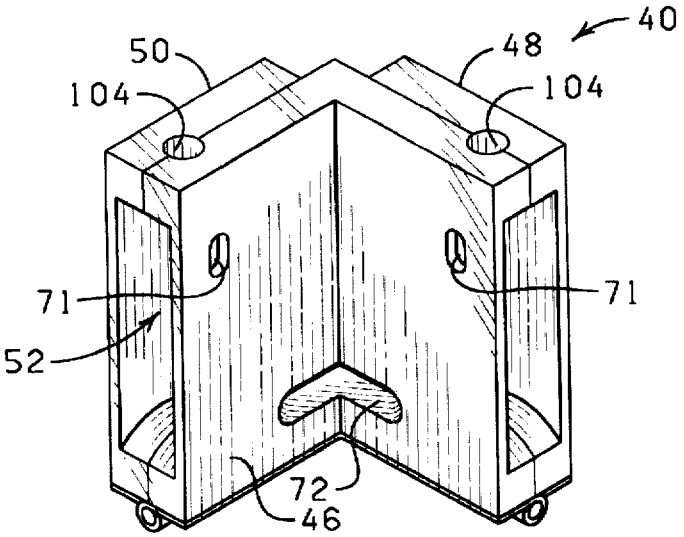
FIG. 4 is a perspective view of the safety shield of the present invention showing the cover plates in a closed position.
Figure 5:
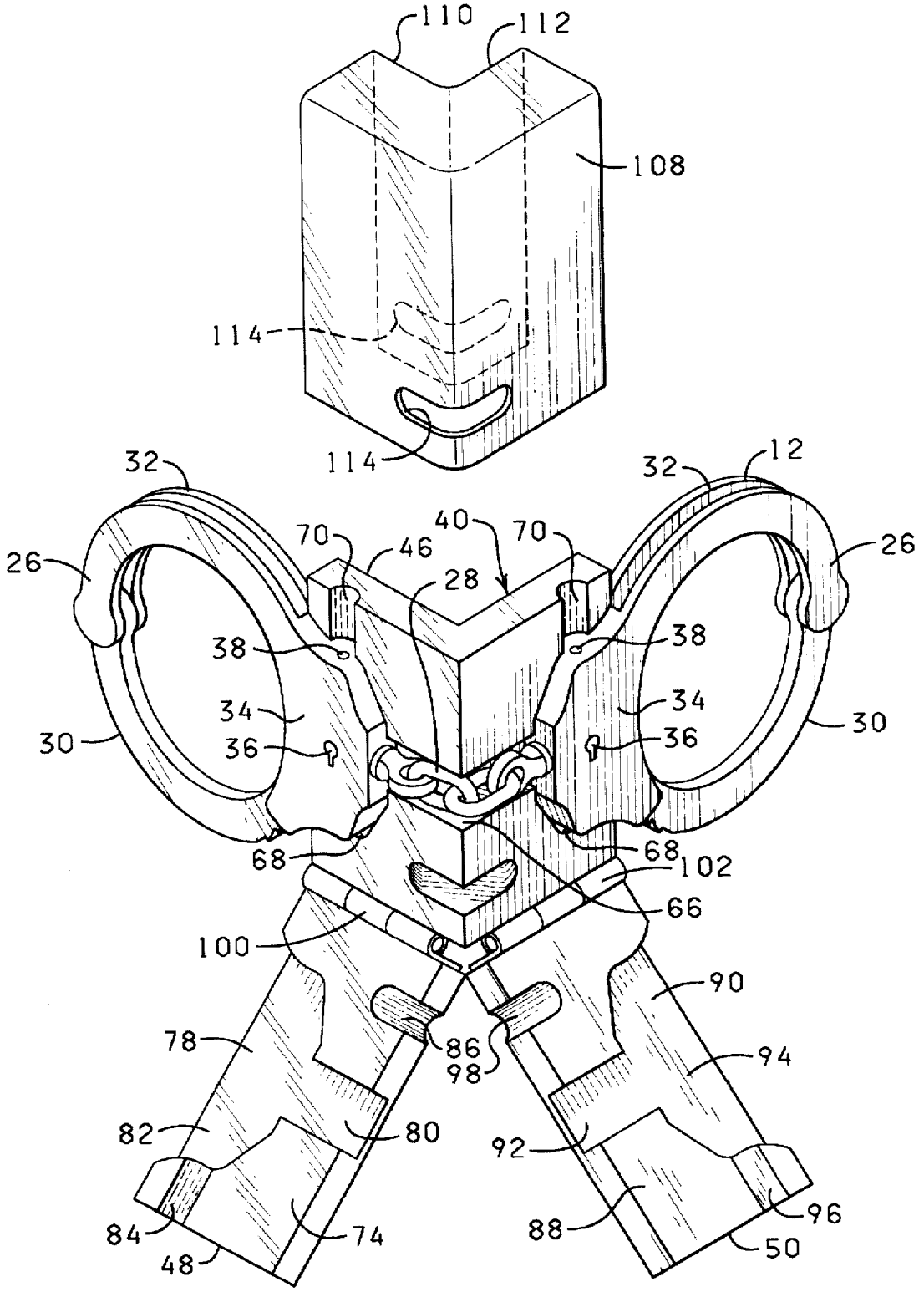
FIG. 5 is a perspective view of the safety shield of the present invention with a pair of handcuffs.
Figure 5:
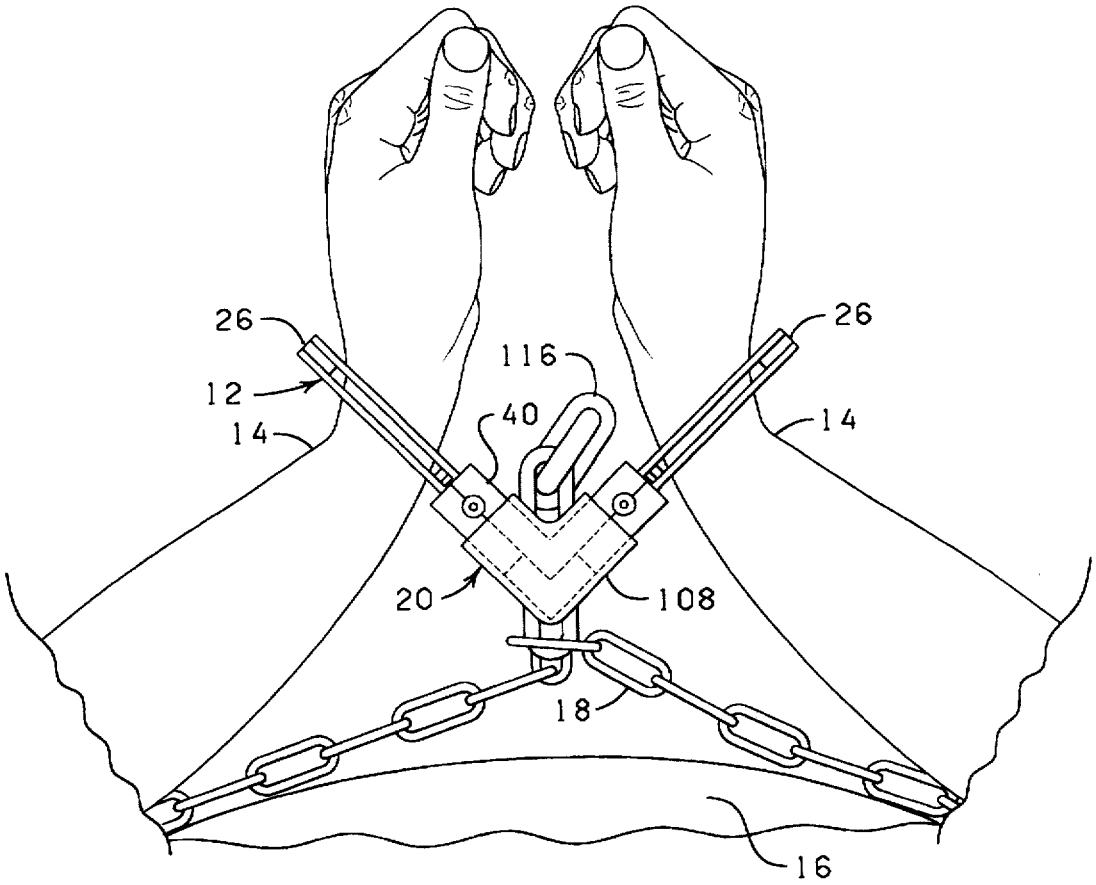

Referring now to FIGS. 2–6, a safety shield 20 positionable about the handcuffs 12 and constructed in accordance with the present invention is illustrated. The handcuffs 12, best illustrated in FIG. 5, are conventional double-lock handcuffs. The handcuffs 12 include a pair of wristlets 26 pivotally and rotatably connected by a link chain 28. Each wristlet 26 includes a ratchet bar 30 pivotally connected to a double strand wristlet body 32 having internal teeth (not shown) which permit rotation of the ratchet bar 30 only inwardly therethrough, but prevent withdrawal in the opposite direction. Each wristlet 26 further includes an enlarged body portion 34 in which a first lock 36 for lockingly engaging the ratchet bar 30 and a second lock 38 for fixing the circumference of the wristlet 26 are housed.

The safety shield 20 is uniquely configured whereby the wristlets 26 of the handcuffs 12 are set in an angular relationship relative to one another when the safety shield 20 is positioned about the handcuffs 12. By securing the wristlets 26 in such an angular relationship, the wristlets 26 are permitted to lay substantially concentrically around the wrists 14 of the individual when the wrists 14 are positioned in a corresponding angular relationship, such as when the individual's wrists 14 are secured in close proximity to the individual's torso 16.

Figure 2:
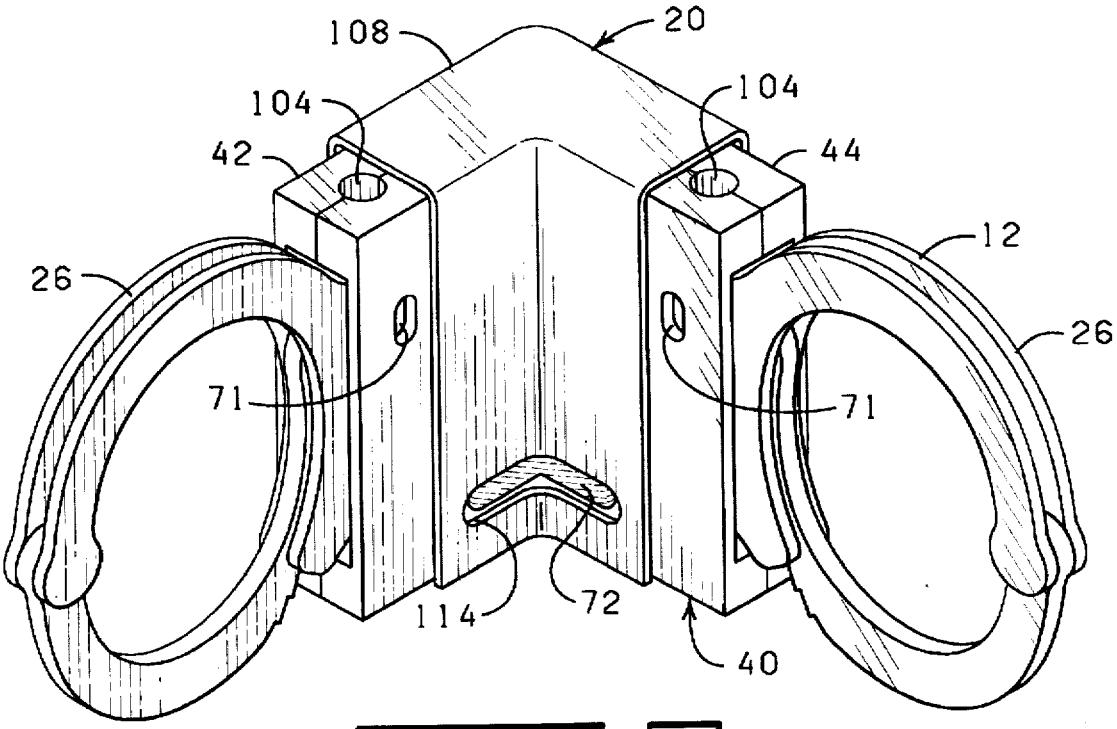
FIG. 2 is a perspective view of a safety shield constructed in accordance with the present invention shown positioned about a pair of handcuffs.

The safety shield 20 includes a housing 40 having a first end portion 42 and a second end portion 44 (FIG. 2) wherein the second end portion 44 is angularly disposed relative to the first end portion 42. As best illustrated in FIGS. 2 and 6, the housing 40 is positionable about the chain 28 of the handcuffs 12 such that the wristlets 26 are extendable from the first and second end portions 42, 44 of the housing 40 in an angular relationship to one another when the housing 40 is positioned about the chain 28 such that upon securing the wristlets 26 about the wrists of an individual the wristlets 26 are disposed substantially concentrically around the wrists of the individual when the individual's wrists are positioned in a corresponding angular relationship.

Referring more specifically to FIG. 3, the housing 40 comprises a V-shaped plate member 46, a first cover plate 48, and a second cover plate 50. The plate member 46, the first cover plate 48 and the second cover plate 50 cooperate to define a V-shaped cavity 52 (FIG. 4) in the housing 40.

The plate member 46 has a first plate portion 54 and a second plate portion 56. The first plate portion 54 is a mirror image of the second plate portion 56 and integrally formed with the second plate portion 56. The first plate portion 54 and the second plate portion 56 are formed at an angle 58 (FIG. 3) with respect to one another. The angle 58 is preferably in a range of from about 90° to about 120°.

The plate member 46 has an inner surface 60 provided with a recess 64 having a narrow chain receiving portion 66 and a pair of oppositely disposed wristlet receiving portions 68. The wristlet receiving portions 68 are configured to receive the body portion 34 of the wristlets 26 as shown in FIG. 5 with the remaining portions of the wristlets 26 extending from the ends of the plate portions 54, 56, respectively.

The plate member 46 further includes a pair of recesses 70 and a pair of openings 71, each of which are in communication with the wristlet receiving portions 68. The plate member 46 is also provided with an elongated slot 72 extending from the first plate portion 54 to the second plate portion 56.

The first cover plate 48 is a mirror image of the first plate portion 54 and therefore has an inner surface 74 provided with a recess 78 having a narrow chain receiving portion 80 and an enlarged wristlet receiving portion 82. The first cover plate 48 further includes a recess 84, which is in communication with the wristlet receiving portion 82. The first cover plate 48 is also provided with a recess 86 corresponding to the portion of the slot 72 formed in the first plate portion 54.

Likewise, the second cover plate 50 is a mirror image of the second plate portion 56 and therefore has an inner surface 88 provided with a recess 90 having a narrow chain receiving portion 92 and an enlarged wristlet receiving portion 94. The second cover plate 50 further includes a recess 96, which is in communication with the wristlet receiving portion 94. The second cover plate 50 is also provided with a recess 98 corresponding to the portion of the slot 72 formed in the second plate portion 56.

The first cover plate 48 is connected to the first plate portion 54 via a hinge 100, and the second cover plate 50 is connected to the second plate portion 56 via a hinge 102. As such, the first and second cover plates 48, 50 are movable relative to the plate member 46 between an open position (FIG. 3) and a closed position (FIG. 4). In the closed position, the inner surfaces and 88 of the first and second cover plates 48 and 50 are brought into face-to-face contact with the inner surface 60 of the plate member 46, whereby the recess 64 of the plate member 46 and the recesses 78 and 90 of the first and second cover plates 48 and 50 cooperate to form the cavity 52 that extends the length of the housing 40. In the closed position, the recesses 84 and 96 of the first and second cover plates 48 and 50 also cooperate with the recesses 70 of the plate member 46 to form a pair of lock access openings 104 (FIG. 4), which are alignable with the second lock 38 of the wristlet 26 when the handcuffs 22 are encased in the housing 40. Finally, when the first and second cover plates 48 and 50 are in the closed position, the recesses 86, 98 of the first and second cover plates 48 and 50 cooperate to form an elongated slot that is aligned with the slot 72 of the plate member Like the lock access openings 104, the openings 71 of the plate member 46 are provided for accessing a second lock (not shown). That is, the openings 71 provide access to a second lock positioned in a different location than that shown herein. More specifically, the openings 71 permit the safety shield 20 to be used with a pair of handcuffs having the second lock positioned on the side of the enlarged body portion, such as found in a pair of handcuffs manufactured by Smith & Wesson of Houlton, Maine. It will be appreciated by those of ordinary skill in the art that openings can be formed in the housing 40 in various locations to provide access to the second locks of a variety of handcuffs when the housing 40 is encompassed about the handcuffs.

The first and second cover plates 48 and 50 are secured in the closed position with a cover plate retainer member 108 (FIGS. 2 and 5). The cover plate retainer member 108 has a first U-shaped portion 110 and a second U-shaped portion 112 wherein the first and second U-shaped portions 110 and 112 are formed at an angular relationship with respect to one another such that the cover plate retainer member 108 is slidably receivable over the housing 40 (FIG. 2) when the first and second cover plates 48 and 50 are in the closed position so as to secure the first and second cover plates 48 and 50 in the closed position.

The cover plate retainer member 108 has a pair of elongated slots 114 adapted to align with the slot 72 and the slot formed by recess 86 and 98 when the cover plate retainer member 108 is positioned over the housing 40.

It will be appreciated that the various components of safety shield 10 may be molded from suitable metals or plastics. For example, the housing 40 can be formed of a plastic while the cover plate retainer member 108 can be formed of a metal, such as aluminum.

In use, the first and second cover plates 48 and 50 are moved to the open position (FIG. 3) wherein the chain 28 and wristlets 26 are positioned in the corresponding recesses 64 of the plate member 46 (FIG. 5). The first and second cover plates 48 and 50 are then moved to the closed position (FIG. 4) and the cover plate retaining member 108 is slidably disposed over the housing 40 (FIG. 2). The wristlets 26 may then be applied to the individual's wrists 14 and the safety shield 20 secured to the torso 16 of the individual with the belly chain 18 (FIG. 6). One end of the belly chain 18 is extended through the aligned slots of the housing 40 and the retainer member 108 and secured thereto in a conventional manner, such as a padlock 116. As illustrated in FIG. 6, the V-shaped configuration of the safety shield 20 provides the advantages of immobilizing the handcuffs and covering the first locks while at the same time permitting the wristlets to lay substantially concentrically around the wrists of an individual when the individual's wrists are positioned in a substantially corresponding angular relationship.

From the above description it is clear that the present invention is well adapted to carry out the objects and to attain the advantages mentioned herein as well as those inherent in the invention. While presently preferred embodiments of the invention have been described for purposes of this disclosure, it will be understood that numerous changes may be made which will readily suggest themselves to those skilled in the art and which are accomplished within the spirit of the invention disclosed and as defined in the appended claims.

What is claimed is:

1. A safety shield for a pair of handcuffs, the handcuffs including a pair of wristlets interconnected with a flexible chain, the safety shield comprising:

a housing having a first end portion, a second end portion angularly disposed relative to the first end portion, and a cavity extending through the housing from the first end portion to the second end portion, the handcuffs being receivable in the cavity of the housing such that the wristlets of the handcuffs are extendable from the first and second end portions of the housing in an angular relationship to one another.

2. The safety shield of claim 1 wherein the housing comprises:

a V-shaped plate member having a first plate portion and a second plate portion, the first plate portion integrally formed with the second plate portion and disposed in an angular relationship relative to the second plate portion;

a first cover plate hingedly connected to the first plate portion so as to be positionable between an open position and a closed position wherein the first cover plate cooperates with the first plate portion to define a portion of the cavity; and a second cover plate hingedly connected to the second plate portion so as to be positionable between an open position and a closed position wherein the second cover plate cooperates with the second plate portion to define another portion of the cavity.

3. The safety shield of claim 2 further comprising a cover plate retainer member having a first U-shaped portion and a second U-shaped portion wherein the first and second U-shaped portions are formed at an angular relationship with respect to one another such that the cover plate retainer member is slidably receivable over the housing when the first and second cover plates are in the closed position so as to secure the first and second cover plates in the closed position.

4. The safety shield of claim 3 wherein the plate member is provided with an elongated slot extending from the first plate portion to the second plate portion, wherein the first and second cover plates each have an elongated recess which cooperate to form an elongated slot which is substantially aligned with the elongated slot of the plate member when the first and second cover plates are in the closed position, and wherein the cover plate retainer member has a pair of elongated slots adapted to align with the slots of the plate member and cover plates when the cover plate retainer member is positioned on the housing.

5. The safety shield of claim 1 wherein the angle between the first and second end portions of the housing is in a range of from about 90° to about 120°.

6. A safety shield in combination with a pair of handcuffs, the handcuffs including a pair of wristlets interconnected with a flexible chain, the safety shield comprising:

a housing having a first end portion, a second end portion angularly disposed relative to the first end portion, and a cavity extending through the housing from the first end portion to the second end portion, the handcuffs being received in the cavity of the housing such that the wristlets of the handcuffs extend from the first and second end portions of the housing in an angular relationship to one another so that upon securing the wristlets about the wrists of an individual, the wristlets are disposed substantially concentrically around the wrists of the individual when the individual's wrists are positioned in a substantially corresponding angular relationship.

7. The combination of claim 6 wherein the housing comprises:

a V-shaped plate member having a first plate portion and a second plate portion, the first plate portion integrally formed with the second plate portion and disposed in an angular relationship relative to the second plate portion;

a first cover plate hingedly connected to the first plate portion so as to be positionable between an open position and a closed position wherein the first cover plate cooperates with the first plate portion to define a portion of the cavity; and a second cover plate hingedly connected to the second plate portion so as to be positionable between an open position and a closed position wherein the second cover plate cooperates with the second plate portion to define another portion of the cavity.

8. The combination of claim 7 further comprising a cover plate retainer member having a first U-shaped portion and a second U-shaped portion wherein the first and second U-shaped portions are formed at an angular relationship with respect to one another such that the cover plate retainer member is slidably receivable over the housing when the first and second cover plates are in the closed position so as to secure the first and second cover plates in the closed position.

9. The combination of claim 8 wherein the plate member is provided with an elongated slot extending from the first plate portion to the second plate portion, wherein the first and second cover plates each have an elongated recess which cooperate to form an elongated slot which is substantially aligned with the elongated slot of the plate member when the first and second cover plates are in the closed position, and wherein the cover plate retainer member has a pair of elongated slots adapted to align with the slots of the plate member and cover plates when the cover plate retainer member is positioned on the housing.

10. The combination of claim 6 wherein the angle between the first and second end portions of the housing is in a range of from about 90° to about 120°.

* * * * *